US005877696A

United States Patent [19]

Powell

[11] Patent Number: 5,877,696

[45] Date of Patent: Mar. 2, 1999

[54] SECURITY SYSTEM FOR WARHEADS

[76] Inventor: Roger A. Powell, 1740 Hollins Rd., Bensalem, Pa. 19020

[21] Appl. No.: 629,621

[22] Filed: Apr. 9, 1996

[51] Int. Cl.[6] ..... F42C 15/00

[52] U.S. Cl. ..... 340/825.32; 340/825.31; 340/539; 340/540; 340/541; 102/800; 102/211; 89/1.8; 89/1.801; 89/1.11; 89/17; 89/21; 235/400; 235/401; 235/403

[58] Field of Search ..... 340/825.32, 539, 340/541, 568, 540, 544, 633, 691, 825.31; 102/200, 211; 89/1.8, 1.801, 1.11, 17, 21; 235/400, 401, 403

[56] References Cited

U.S. PATENT DOCUMENTS

| | | | |
|---|---|---|---|
| Re. 34,788 | 11/1994 | DuRand, III et al. | 340/550 |
| 4,386,342 | 5/1983 | McKinley | 340/544 |
| 4,688,244 | 8/1987 | Hannon et al. | 379/58 |
| 4,760,393 | 7/1988 | Mauch | 340/825.31 |
| 4,837,555 | 6/1989 | Millar | 340/544 |
| 4,860,653 | 8/1989 | Abouav | 102/200 |
| 4,884,506 | 12/1989 | Guerreri | 102/200 |
| 5,034,686 | 7/1991 | Aspelin | 102/206 |
| 5,548,275 | 8/1996 | Shambayati et al. | 340/573 |
| 5,614,896 | 3/1997 | Monk et al. | 340/945 |
| 5,691,697 | 11/1997 | Carvalho et al. | 340/544 |

*Primary Examiner*—Michael Horabik
*Assistant Examiner*—Yonel Beaulieu

[57] ABSTRACT

A weapons security system composed of containers for storage of warheads or warhead material. The containers are equipped to detect breaches in the enclosure walls and to transmit an alarm signal in the event of a breach. The alarm signal is received by a local control center for transmission to a central weapons command. The central weapons command may also receive the alarm directly. The central weapons command despatches forces to counter the threat identified by the alarm. Also, the central weapons command dispatches electronic authorization or opening codes to the containers or their local guardians. The containers may be equipped with entry deterrent devices and warhead destructive devices which are triggered by the detection of a breach in the enclosure.

18 Claims, 4 Drawing Sheets

SECURITY SYSTEM FOR WARHEADS

BACKGROUND OF THE INVENTION

This invention relates to security systems for warheads and warhead material. Unauthorized access and usurping of warheads and warhead material in the world's stockpile poses a significant risk to world stability and to the lives of its inhabitants. This risk extends to smaller tactical warheads as well as larger strategic warheads. The threat is three fold. First, political/military forces within a government may wish to gain control of warheads to further their political agenda. Second, foreign governments may wish to acquire warheads to intimidate their neighbors. Third, terrorists may wish to acquire warheads to conduct a terror campaign to further their goals. In some areas of the world that have warheads and warhead material, the socioeconomic climate has changed significantly. This creates the potential for local guardians of warheads and warhead material to be compromised by the large sums of money available for unauthorized warhead acquisition. Without a warhead security system that reports directly to a central weapons command center that cannot be compromised without great difficulty, warheads may be stolen and transported beyond the point of retrieval before the central weapons command center is aware of the loss. Therefore, it is extremely advantageous to create a security system that reports virtually instantaneously and directly to a central weapons command center and that is extremely difficult to deceive or disable. This security system allows the central weapons command center to dispatch mobile forces to recover and safeguard the warheads before they can be transported from their home area.

U.S. Pat. No. 4,934,269 discloses other security methods to counter this threat and is hereby incorporated by reference.

OBJECTS OF THE INVENTION

It is an object of this invention to deny undetected and unauthorized access to strategic and tactical warheads and warhead material. If unauthorized access is attempted, it is reported directly to a central weapons command center, virtually instantaneously, using a highly secure communication system, effectively eliminating the need to rely solely on the integrity of local guardians. Further, it is an object to provide multiple channels of communication to central weapons command center that are locally interconnected such that a local alarm will be transmitted on multiple channels to central weapons command center, making interception very difficult. Further., it is an object that the system be simple, cost-effective, and not significantly inhibiting of authorized access to the warheads. Another object is to deny the ability to arm a warhead or deny unobstructed access to a warhead if it is transported beyond a limited local area. Another object is to provide a separate access barrier by the use of a separate arming or unlocking device. A further object is to require an additional portion of an arming code to be entered into or stored in the arming device to produce arming. Another object is to provide modularity of the installation. Another object is to provide detection of a breach of the security enclosure. Another object is to provide intrusion countermeasure devices within the security enclosures. Another object is to provide warhead disablement devices that are activated if the enclosure is breached. Further objects and advantages will be apparent upon reading the following disclosure in conjunction with the drawings.

SUMMARY OF THE INVENTION

This invention is a security system for strategic and tactical warheads and warhead material, henceforth referred to by the general term "warheads", that are stored in secured containers. The system includes a local transmitter/receiver in the local control center to provide all or a portion of an arming or container unlocking code to a separate arming or unlocking device or directly to a container lock. If another portion of the code is required, it is entered by a human operator. Also, the arming or unlocking device can internally store a portion of the code. The transmitter may have a limited range or it may be electrically or fiberoptically coupled to the warheads or the containers, thereby limiting the distance the warheads can be moved before they can no longer be armed and/or the containers unlocked. The local control center and its transmitter/receiver are under the direct control of and in communication with a central weapons command center, thereby removing sole control from local guardians. The local control center continuously monitors local security and reports security status directly to the central weapons command center. Internal sensors monitor the integrity of the local control center, containers, and warheads. If a security breach occurs, the local control center instantly reports to central weapons command center and local alarms are activated. Forces are dispatched to recover any lost warheads before they can be transported from the site. Containers may include anti-intrusion devices and warhead disablement features.

DESCRIPTION OF THE PREFERRED EMBODIMENT

Figure 1:
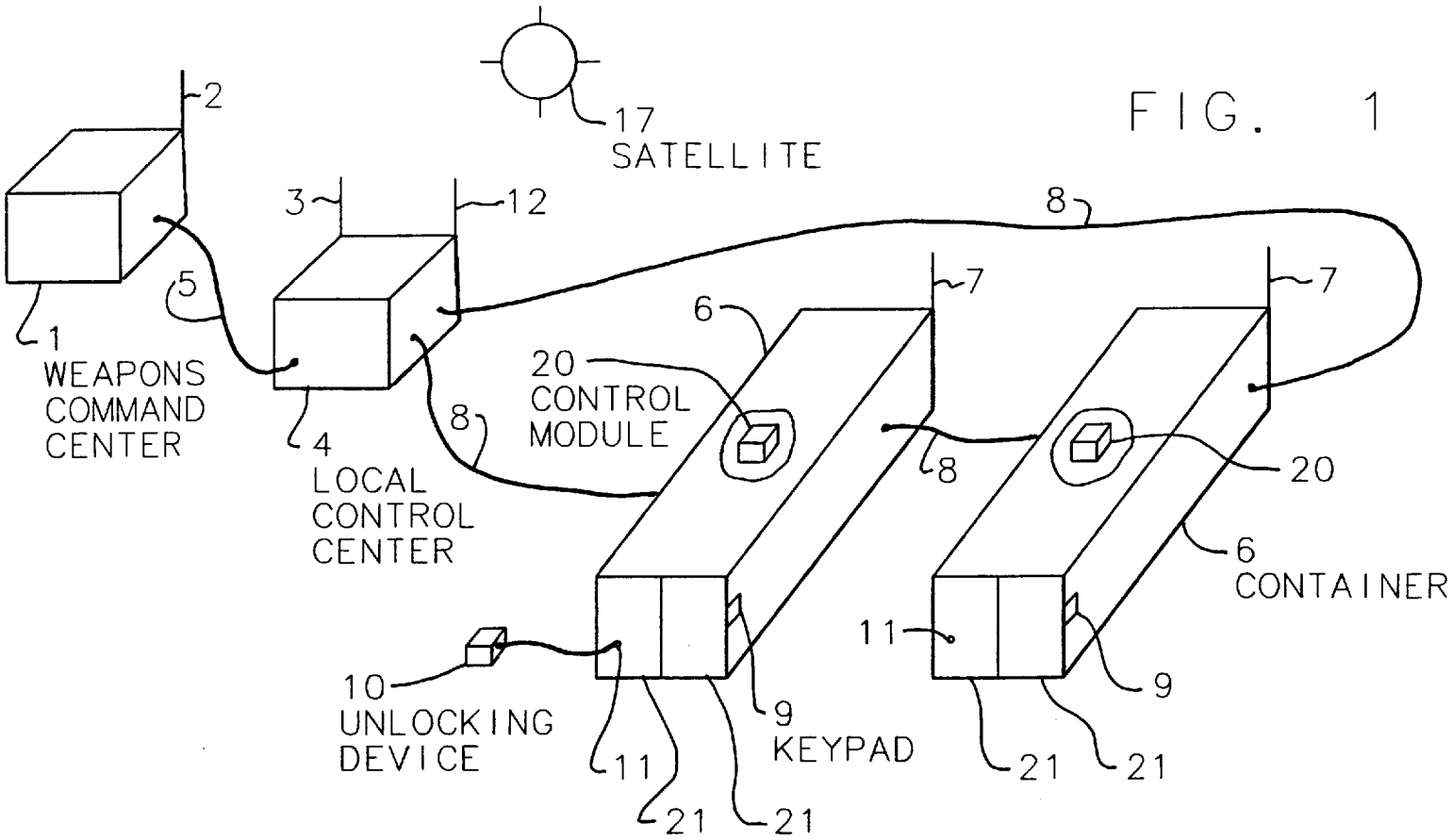
FIG. 1 shows an embodiment of the security system including the central weapons command center, local control center, and containers.

In FIG. 1, a central weapons command center 1 is equipped with a transmitter/receiver. Alternatively, several transmitters may be located at dispersed locations and be under remote control of the central weapons command center 1. Central weapons command center 1 may be the sole repository for the unlocking codes for the containers in a political jurisdiction. Alternatively, the unlocking codes may be held by the civilian leadership and passed to the central weapons command center when access is authorized. When access is authorized, the unlocking codes are transmitted by airborne broadcast from the central weapons command center antenna 2 to the antenna 3 of each local control center 4. These commands may be relayed by a satellite 17 positioned over the area in geosynchronous orbit. Also, the unlocking codes may be sent by landline 5. The landline 5 is a signal carrying cable. This cable may be an electrical conductor such as copper, a fiberoptic material such as glass, a coaxial cable, or the like. When the local control center 4 receives the unlocking codes, it transmits them by airborne broadcast from its antenna 12. Alternatively, the local control center may transmit from its antenna 3. That signal is received by each antenna 7 that is coupled to the container control module 20 in each individual container 6. Alternatively, the codes may be sent by the local control center 4 to each container control module 20 in each container 6 by an electrical or fiberoptic cable 8.

When the unlocking code is received by a container control module 20 in a container 6, the container control module 20 compares the received code to a previously stored code. If the codes match, or correspond symbol-by-symbol in the same order, the container control module 20 activates electrical or pneumatic actuators to unlock the container doors 21 and deactivates any intrusion deterrent devices or warhead disablement devices, so that the local personnel have ready access to the warheads stored in the containers. The electrical or fiberoptic cable 8 may form a continuous path through the container control modules 20, so that a coded security signal from the local control center 4 may be sent continuously into the first end of the cable 8 to pass through it and exit from the second end of the cable 8 as it returns to the local control center 4. If the continuity of the cable 8 is disrupted, the local control center 4 will not receive the security signal from the second end of the cable and will transmit an alarm signal from its antenna 3 to antenna 2 at the central weapons command center 1. As the cable 8 passes through each container control module 20 in each container 6, the container control module 20 is equipped to interrupt the security signal in the cable 8, and the container control module 20 will do so if it detects an attempt to breach or open its enclosure. Since moving the container 6 any significant distance would require cutting the cable 8, this would also be detected by the interruption of the security signal in the cable 8. Since the local control center 4 is sending and receiving the security signal in cable 8, the local control center 4 knows what the returning signal should be. Therefore, the local control center 4 can send a continuous string of random numbers or the like and compare the returning signal to that which was sent. This method maintains the security of the cable loop and eliminates the possibility of unauthorized personnel inserting a new loop of cable to bypass a container 6 so that it may be opened. This method of using a continuous loop of electrical or fiberoptic cable that carries a continuous signal from a source and returns it to the source may also be applied to the landline 5 connecting the central weapons command center 1 with the local control center 4. The central weapons command center 1 would act as the source of the signal and would receive the returning signal, and the local control center 4 could interrupt the signal to trigger an alarm. Alternatively, the central weapons command center 1 may be connected to the local control center 4 by airborne transmission or landline 5 and the central weapons command center 1 would send different coded messages to the local control center 4. The local control center 4 would respond to each message with another secretly predetermined coded message. The central weapons command center 1 would receive the responding message and determine if it was correct. If it was incorrect, an alarm would be raised indicating that an attempt was being made to deceive the system. If no response was received, an alarm would be raised indicating that the security of local control center 4 had been breached. The local control center 4 would destroy its response message apparatus if it detected a breach in its security. Alternatively, the container control module 20 in each container 6 may broadcast an alarm signal from its antenna 7 if its enclosure is breached. The alarm signal is received by antenna 3 or 12 coupled to the local control center 4. The local control center 4 would then transmit an alarm signal to the central weapons command center 1.

Alternatively, when the unlocking codes are received by the container control module 20 in each container 6, an external keypad 9 may be enabled to receive an additional portion of the unlocking code entered by a human operator. When this additional portion is entered, the container control module 20 compares the received unlocking code to a previously stored unlocking code. If the codes match, the container control module 20 causes unlocking to occur. Alternatively, when the container control module 20 in a container 6 receives the code, it may enable an electrical port 11 on the container 6 to which the human operator inserts a connector from an unlocking device 10 that provides an internally stored code portion and may have a keypad 9 for additional code input by the human operator. When these codes match the previously stored codes, the container control module 20 unlocks the container doors 21. Alternatively, the door 21 may be externally locked with keys provided to local guardians. In this case, the unlocking sequence described would inactivate alarms and countermeasures. The local control center 4 may be housed in a portion of a container 6 or a similar enclosure with security devices similar to a container 6 so that it may enjoy the same level of security as that of the container 6. The local control center 4 contains an internal power supply that allows it to transmit an alarm signal if external power is interrupted. The local control center 4 maintains a continuous communication with the central weapons command center 1 to verify that it is secure. Alternatively, the door 21 may be externally locked with keys provided to local guardians. The locks only open the physical barriers and deactivate any countermeasures that are utilized, but the alarms are always active. Therefore, any opening of the door 21 will cause an alarm to be transmitted to central weapons control. Response forces would be dispatched if the opening was unauthorized.

Figure 2:
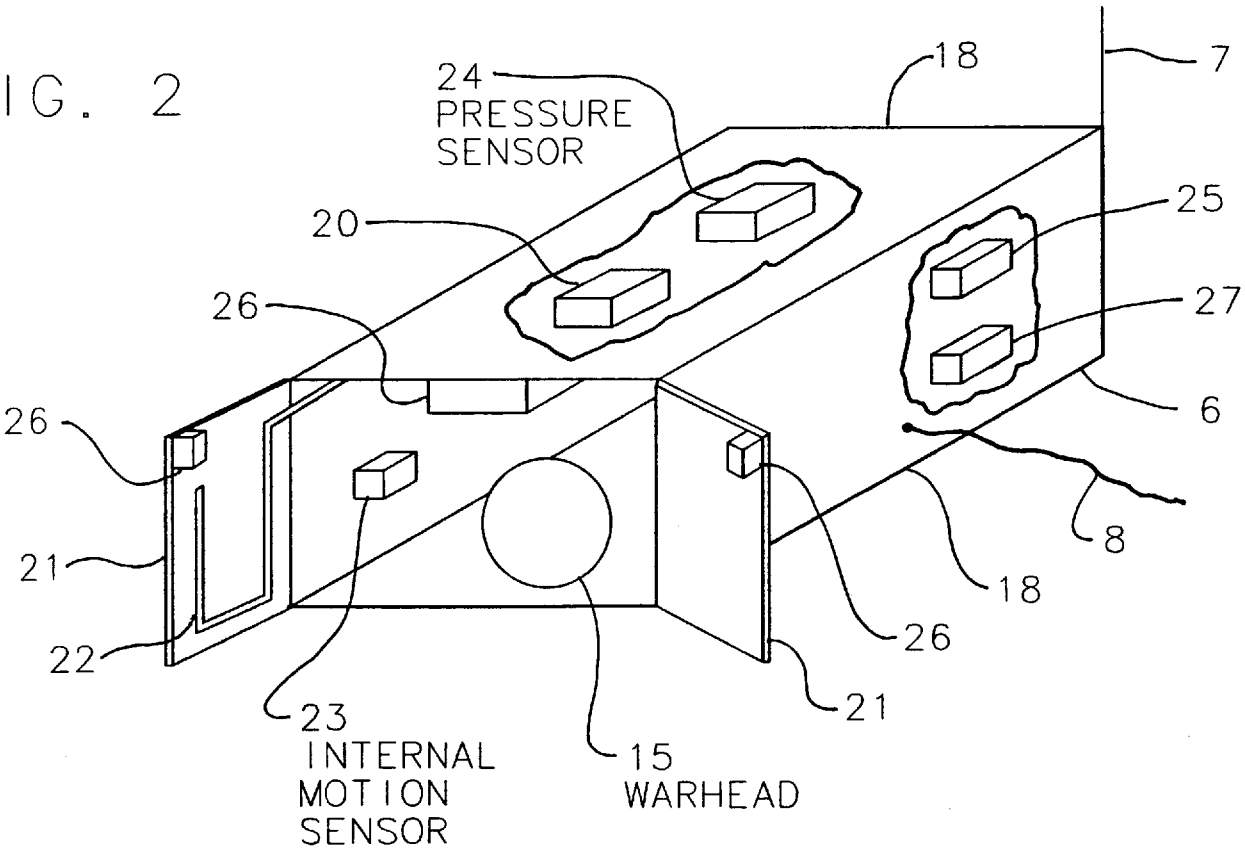
FIG. 2 shows a container in more detail.

FIG. 2 shows the container 6 in more detail. The container 6 is preferably approximately 8 feet wide by 10 feet high by either 20 feet or 40 feet long. These are the same approximate dimensions of overseas shipping containers. The container 6 may be constructed using the same fabrication techniques as the overseas shipping containers and would be shipped using the existing methods of sea transport, and would be transferred to standard container trailers for over the road local transport. The container walls, doors, floor, and top constitute the enclosure 18 and totally enclose the interior space and act as the security barrier. Typically, these members are constructed of steel or aluminum, but some nonmetallic windows may be used to allow the passage of electromagnetic radiation for communication. Each container would be anchored internally to its foundation, thereby requiring a breach or unauthorized opening in its enclosure to move it.

Alternatively, the containers 6 can be larger or smaller. The disadvantage to making them larger is that they are not readily transportable when completely assembled and must be field erected at the site which increases the installation costs. The disadvantage of smaller containers is an increased cost of containers for a given number of warheads and the detriment of being more readily transportable by unauthorized personnel. Smaller containers could be such that they would house only one warhead. Optimal container size can only be determined when all factors are economically evaluated for a particular case. Standardization on the preferred container size has the advantage of being modular and capable of housing a variety of warheads. The container 6 has at least one large door 21 for loading and unloading the warheads.

Within each container 6 is a container control module 20 that contains internal electronic sensors and electronics that are well known in the art to monitor the container enclosure 18 for breaches or unauthorized openings. One method uses electrical tapes 22 applied to the internal surfaces of the container 6 which carry and electrical current that are continuously monitored by the container control module 20. If a tape 22 is cut during an attempted enclosure breach, the electrical current is interrupted and the container control module 20 sends an alarm signal to the local control center 4 where it is relayed to the central weapons command center 1 and local alarms are sounded also. Also, internal motion sensors 23 that are well known in the art may be located in the container 6 and coupled to the container control module 20. If the enclosure 18 is breached or the doors 21 are opened, the motion sensor 23 would detect the motion and report it to the container control module 20 that would send an alarm signal to the local control center 4. Alternatively, the internal gas pressure in the container 6 may be maintained at slightly above or below atmospheric pressure and be monitored by internal pressure sensors 24 that are coupled to the container control module 20. If an enclosure 18 is breached, the internal pressure will change to that of the external atmospheric pressure as gas or air flows through the breach in the enclosure 18. The pressure sensor 24 detects the change and reports it to the container control module 20 that sends the alarm signal to the local control center 4. Preferably, the internal pressure is above atmospheric and is maintained by a pressurized air or gas supply external to the container 6 and an internal valve that permits gas flow into the container 6 at small rates to compensate for leakage in the enclosure. Using an external supply of gas allows it to be maintained and replenished without needing to enter the container 6. An elastomeric liner or bladder may be applied to the interior of the container 6 to minimize leakage. The gas or air used to fill the container should be conditioned so that it is moisture-free to minimize corrosion. The container 6 has internal power storage capability and is externally supplied with electrical power and compressed air. The container control module 20 monitors these supplies and if the external supplies are interrupted, the container control module 20 generates an alarm signal to the local control center 4 that transmits to the central weapons command center as previously described.

The container 6 may also contain intrusion-deterrent features that delay the entry of humans. For example, a high intensity sonic horn 25 triggered to sound if an enclosure breach occurs may be used. Alternatively, a non-life-supporting gas such as nitrogen or carbon dioxide, or a debilitating gas may be used to fill the container 6 or released into the container 6 if the enclosure is breached.

The container 6 may also contain devices to disable the warhead 15 if there is an enclosure breach. An incendiary device 27 may be used to ignite an internal fire that supplies enough heat to melt and destroy all electronic and wiring components in the warhead 15. Further, an aluminum or like material cover over each warhead 15 may be designed to melt and encapsulate the warhead during a breach initiated fire. The enclosure 18 itself may be designed to melt and deform over the warheads 15 stored within it during a breach initiated fire.

Figure 3:
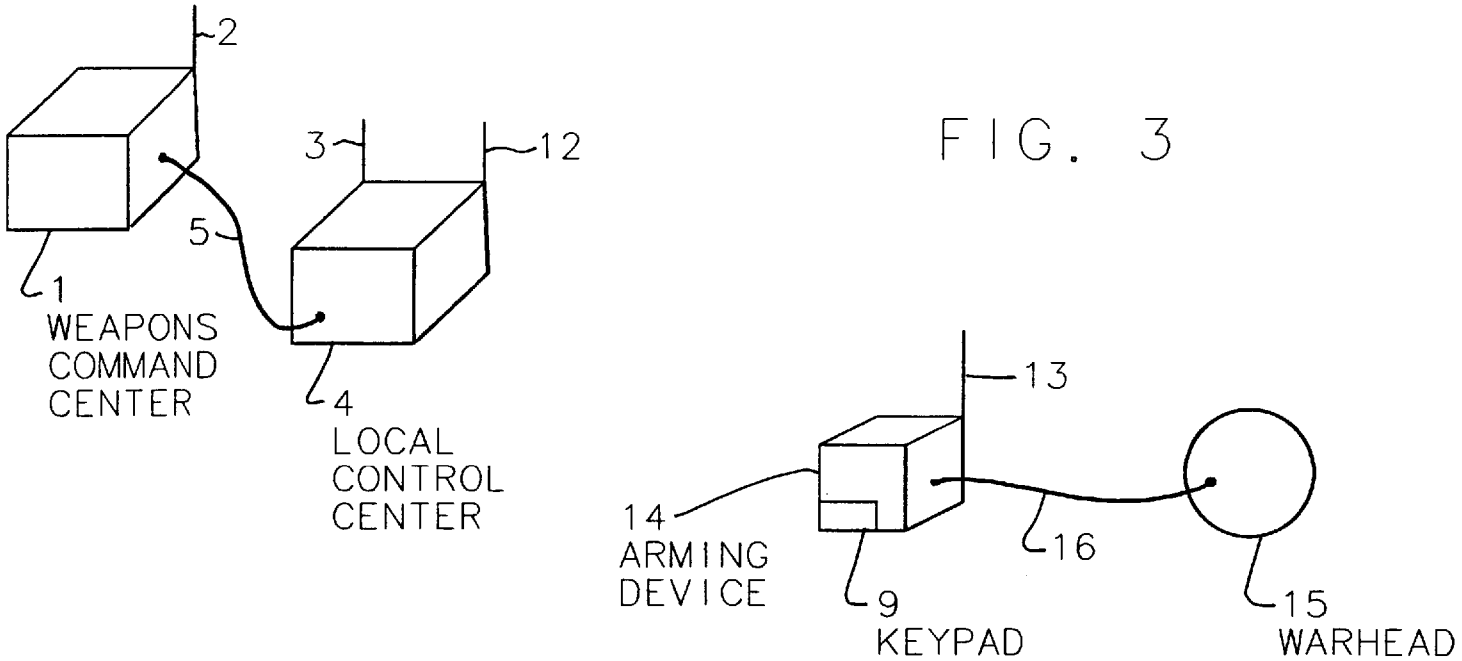
FIG. 3 shows another embodiment of the security system including an arming device and a local limited-range transmitter at the local control center.

FIG. 3 shows another embodiment of the invention. When activated by the central weapons command center 1, a central transmitter, transmits arming codes from its antenna 2 to the antenna 3 of the local control center 4. Alternatively, the codes may be sent by secure landline 5. The local control center 4 transmits the arming code via broadcast on its antenna 12. This is received by the antenna 13 on an arming device 14. The arming device 14 is electrically attached via a cable 16 to a warhead 15. The arming code transmitted by the local control center 4 may be a complete arming code or a portion of the arming code. If desired, a second portion of the code may be entered by a keypad 9 on the arming device 14 by a human operator. Optionally, a third portion of the code may be stored in the arming device 14 itself. Also, under this third option, the human operator's portion of the code may be deleted, and only the externally transmitted portion from antenna 12 and the portion stored in the arming device 14 would be required for arming. In this case, the human operator would only have to connect the cable 16 to the warhead 15 and press a button on the arming device 14. When the complete arming code is received by the warhead 15 via the cable 16, the warhead 15 compares the received arming code to a previously stored arming code, if the codes match, the warhead 15 becomes armed. The range or distance of transmission from the antenna 12 of the local control center 4 is purposefully limited by the power of its transmitter. Therefore, if the warhead 15 is stolen and transported beyond the range of the transmitter, it cannot be armed. Further, the local control center 4 transmitter only sends the arming codes when authorized. Therefore, if the warhead 15 were stolen when the transmitter was not sending codes, the warhead 15 could not be armed. Further, since the local control center 4 transmitter would rarely send codes, the possibility for intercepting them for unauthorized replication to deceive the arming device is small. The warhead 15 and arming device 14 contain anti-tampering systems, designed to destroy the arming circuitry if tampering is detected. The functions of antenna 3 and antenna 12 may be combined into a single antenna provided the respective transmission and receiving frequencies allow it.

Figure 4:
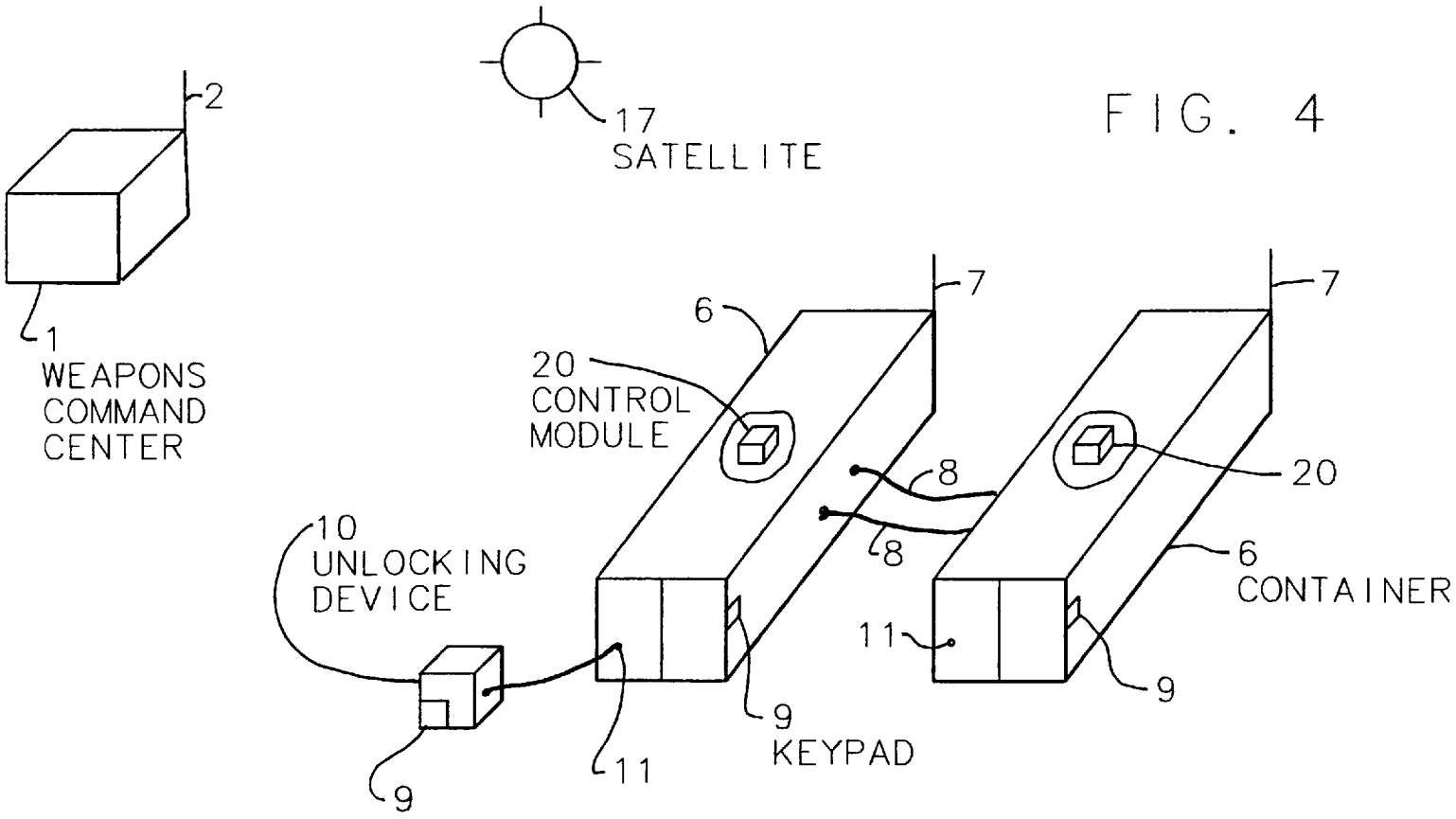
FIG. 4 shows another embodiment of the security system including the central weapons command center, and an interconnected group of containers.

FIG. 4 shows another embodiment of the invention. One or more central transmitters/receivers controlled by the central weapons command center 1 broadcast the unlocking codes from antenna 2 directly to the antenna 7 of the container control module 20 of each container 6. Each container control module 20 may be electrically coupled to a keypad 9 into which a human operator enters another portion of the unlocking code. Alternatively, a human operator may use an unlocking device 10 that he connects to a port 11 on each container 6 that is connected to its container control module 20. The human operator enters on a keypad 9, which is on the unlocking device 10, a second portion of an unlocking code to unlock the container 6. Alternatively, the unlocking device 10, may have an internally stored portion of the unlocking code that supplement or replaces that entered by the human operator. When the container control module 20 receives all portions of the unlocking code, it compares it to a previously stored code. If the codes match, the container control module 20 unlocks the container 6. If the unlocking codes have not been transmitted, any attempt to open the container 6 will be detected by the container control module 20 as previously described and the container control module 20 will broadcast an alarm signal to the central weapons command center 1 transmitter/receiver and the triggering of local alarms. The container 6 can include the deterrent and disablement features previously described.

The container control module 20 in each container 6 sends a status checking message from its antenna 7 to the antenna 2 of the central weapons command center 1 transmitter/receiver to verify its readiness and that it is not in an alarm condition. Each message would contain information to identify the transmitting container. This message may be relayed by an earth orbiting satellite 17. The container control modules 20 of several containers 6 may be interconnected by a fiberoptic cable 8 or the like that provides a continuous security monitoring loop akin to that previously described. In the simplest form, one container control module 20 would transmit a security signal into a first end of the cable 8 and receive the returning security signal from the second end of the cable 8, thereby replacing the local control center 4 described in FIG. 1. Each other container control module 20 would monitor the signal and be capable of interrupting the security signal. If the security signal was interrupted, all container control modules 20 would broadcast an alarm signal to the central weapons command center 1 transmitter/receiver. The broadcast communication method may use the spread spectrum technique in which the transmitter hops to different frequencies in a secret pattern during the transmission. The hopping pattern is known to the receiver that simultaneously hops to the transmitted frequency. This method makes jamming and false signaling very difficult.

While the specific embodiments of the invention have been illustrated and described herein, it is realized that many modifications and changes will occur to those skilled in the art. It is therefore to be understood that the appended claims are intended to include all such modifications and changes that fall within the true spirit and scope of the invention.

I claim:

1. A warhead security system, comprising:

a central weapons command center, a local control center having means for communicating with said central weapons command center and communicating with a plurality of container control modules in the local area, said local control center having means for receiving an alarm signal from any said container control modules and transmitting an alarm signal to said central weapons command center, said local control center being spatially separated from said plurality of container control modules, a plurality of containers, each having a continuous enclosure and said container control modules, said container control module being coupled to means for detecting a breach of said enclosure and having means for communicating with said local control center, said container control modules transmitting an alarm signal when a breach of said enclosure is detected by means for communicating with said local control center.

2. A warhead security system according to claim 1, further comprising a door in said container and means for locking said door, said locking means coupled to said container control module, said container control module after receiving communication from said local control center in a first coded message, comparing said first coded message to a second coded message previously stored in said container control module, if said first coded message matches said second coded message, said container control module acting to unlock said locking means.

3. A warhead security system according to claim 1, wherein said means for communicating with said local control center is a cable having a first end that originates at said local control center, enters said container control module in said container, exits said container control module, and having a second end that terminates at said local control center, said local control center transmitting a signal into said first end of said cable and local control center monitoring the return of said signal from said second end of said cable, wherein said means for sending an alarm message is said container control module having means for interrupting said signal in said cable.

4. A warhead security system according to claim 1, wherein said means for communicating with said central weapons command center is responding to a first coded message transmitted by central weapons command with a second coded message transmitted by said local control center, when an alarm condition exists at said local control center, said local control center ceases to respond with said second coded message.

5. A warhead security system according to claim 1, further comprising a door in said container and means for locking said door, said locking means coupled to said container control module, said container control module being coupled to means for locally entering a first coded message into said container control module, said container control module comparing said first coded message to a second coded message previously stored in said container control module, if said first coded message matches said second coded message, said container control module acting to unlock said means for locking said door.

6. A container for storing warheads, comprising:

a continuous enclosure, a container control module, said container control module coupled to means for monitoring the integrity of said enclosure, said means for monitoring the integrity of said enclosure employs means for adding a volume of gas to create an internal pressure in said container that is greater than the external pressure, means for monitoring the value of said internal pressure, adding additional gas intermittently to replace gas lost due to leakage, and generating an alarm signal when said internal pressure decreases rapidly indicating a breach in the enclosure, said container control module having means for transmitting an airborne broadcast alarm signal having a frequency greater than 30,000 hertz to a remote receiver when said enclosure is breached.

7. A container according to claim 6, further comprising a door in said container and means for locking said door, said locking means coupled to said container control module, said container control module being coupled to means for locally entering a first coded message into said container control module, said container control module comparing said first coded message to a second coded message previously stored in said container control module, if said first coded message matches said second coded message, said container control module acting to unlock said means for locking said door.

8. A container according to claim 6, further comprising means for deterring the unauthorized entry of humans into said container.

9. A container according to claim 6, further comprising means for destructively disabling said warhead, said means for disabling being coupled to said container control module, said container control module activating said means for disabling if a breach of said enclosure is detected.

10. A warhead security system, comprising:

a central weapons command center, said central weapons command center having means for transmitting arming codes to a local command center, a local control center having an airborne transmitter, said transmitter broadcasting airborne electromagnetic arming codes upon receipt of said codes from central weapons command, said transmitter having a limited effective range of airborne transmission of said arming codes, means for arming a warhead, said arming means having means for receiving said airborne electromagnetic arming codes and transmitting said electromagnetic arming codes to a warhead, thereby arming said warhead.

11. A warhead security system according to claim 10, further comprising within said means for arming, means for adding an additional portion of an arming code to said broadcast airborne arming codes.

12. A warhead security system according to claim 10, wherein said means for arming a warhead is housed in a device that is separated from said warhead.

13. A warhead security system, comprising:

a first container having a continuous enclosure, and a first container control module, said first container control module being coupled to means for detecting a breach of said enclosure and having means for communicating with a central weapons command center, said first container control module having means for transmitting an alarm signal in response to said detection of a breach of said enclosure coupled to said means for communicating with a central weapons command center, a second container having a continuous enclosure and a second container control module, said second container control module being coupled to means for detecting a breach of said enclosure and having means for communicating with said central weapons command center, said second container control module having means for transmitting an alarm signal in response to said detection of a breach of said enclosure coupled to said means for communicating with said central weapons command center, a central weapons command center, said central weapons command center having means for receiving an alarm signal from said first container control module and from said second container control module, and having means for indicating an alarm signal has been transmitted by any container control module, means for mutually communicating between said first container control module and said second container control module, each container control module monitoring said means for mutually communicating to detect an alarm signal from other container control module, thereupon transmitting an alarm signal to said central weapons command center.

14. A warhead security system, according to claim 13, wherein said means for mutually communicating is a cable having a first end that originates at said first container control module in said first container, enters said second container control module, exits said second container control module, and having a second end that terminates at said first container control module, said first container control module transmitting a signal into said first end of said cable and said first container control module monitoring the return of said signal from said second end of said cable, wherein said means for transmitting an alarm message being said second container control module having means for interrupting said signal in said cable.

15. A warhead security system according to claim 13, wherein said means for receiving an alarm signal is said container control module ceasing to respond to a first coded message transmitted by said central weapons command center with a second coded message transmitted by said container control module, when an alarm condition exists at said container control module.

16. A warhead security system according to claim 13, further comprising means for deterring the unauthorized entry of humans into said container.

17. A warhead security system according to claim 13, further comprising means for disabling said warhead, said means for disabling being coupled to said container control module, said container control module activating said means for disabling when the integrity of said enclosure is breached.

18. A warhead security system according to claim 13, wherein said means for detecting a breach of said enclosure is maintaining an internal pressure in said enclosure that is greater than the external pressure, monitoring the value of said internal pressure, and generating an alarm signal when said internal pressure decreases.

* * * * *